US007556482B2

(12) United States Patent
Benco et al.

(10) Patent No.: US 7,556,482 B2
(45) Date of Patent: Jul. 7, 2009

(54) SCROLL COMPRESSOR WITH ENHANCED LUBRICATION

(75) Inventors: Michael G. Benco, Onalaska, WI (US); Alan H V Eber, La Crosse, WI (US); Rodney L. Lakowske, La Crosse, WI (US)

(73) Assignee: Trane International Inc., Piscataway, NJ (US)

( * ) Notice: Subject to any disclaimer, the term of this patent is extended or adjusted under 35 U.S.C. 154(b) by 7 days.

(21) Appl. No.: 11/170,448

(22) Filed: Jun. 29, 2005

(65) Prior Publication Data

US 2007/0003424 A1 Jan. 4, 2007

(51) Int. Cl.
*F04C 18/00* (2006.01)

(52) U.S. Cl. ..... 418/55.6; 418/55.1

(58) Field of Classification Search ..... 418/55.1–55.6, 418/75, 76, 79, 81, 94, 98; 417/281, 424.1, 417/423.13, 424.2, 910.5; 184/6.16, 6.18
See application file for complete search history.

(56) References Cited

U.S. PATENT DOCUMENTS 2,124,239 A * 7/1938 Smith ..... 417/372
2,976,438 A * 3/1961 Luber et al. ..... 310/83
4,403,927 A 9/1983 Butterworth et al.
4,575,320 A 3/1986 Kobayashi et al.
4,702,682 A * 10/1987 Inaba et al. ..... 418/55.6
4,702,683 A * 10/1987 Inaba et al. ..... 418/55.6
4,877,381 A 10/1989 Johnson et al.
4,997,349 A 3/1991 Richardson, Jr.
5,013,225 A 5/1991 Richardson, Jr.
5,439,361 A * 8/1995 Reynolds et al. ..... 418/55.6
6,012,911 A * 1/2000 Hirooka et al. ..... 418/55.5
6,361,296 B1 * 3/2002 Hirooka et al. ..... 418/55.5
6,416,851 B1 * 7/2002 Kuroiwa et al. ..... 428/304.4

* cited by examiner

*Primary Examiner*—Thomas Denion
*Assistant Examiner*—Douglas J. Duff
(74) *Attorney, Agent, or Firm*—William O'Driscoll

(57) ABSTRACT

Lubrication of bearing surfaces in a scroll compressor is enhanced by a vent arrangement which makes use of increased centrifugal force, achieved by locating the outlet of the vent arrangement radially outside of the nominal circumference of the compressor's drive shaft, to both remove refrigerant gas from compressor locations where such gas can inhibit the flow and delivery of lubricant to such surfaces and to increase the lift of lubricant out of the compressor's lubricant sump. Oil retained in the upper surface of the compressor drive shaft is made immediately available for bearing lubrication upon compressor start-up to further enhance compressor lubrication.

10 Claims, 4 Drawing Sheets

FIG. 1
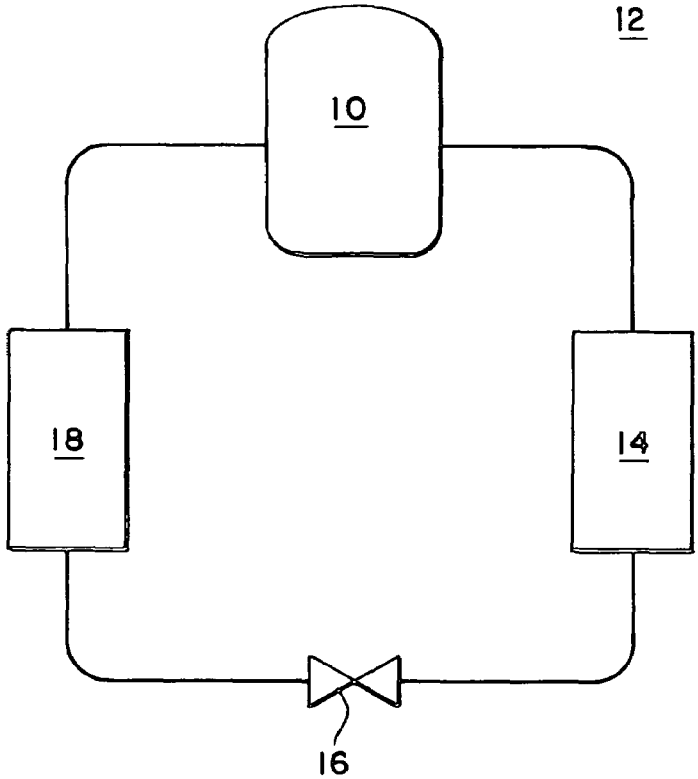
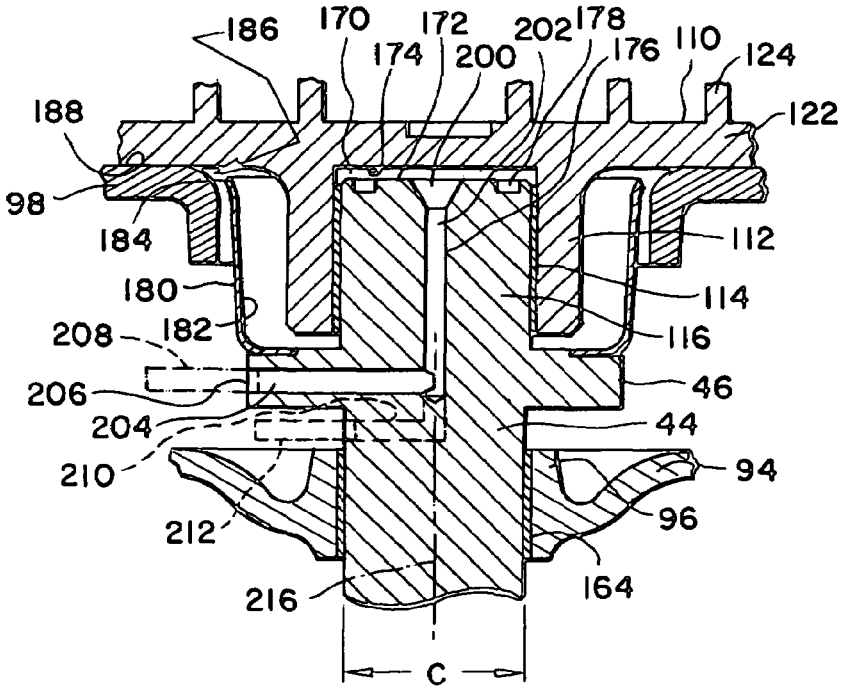
FIG. 4

SCROLL COMPRESSOR WITH ENHANCED LUBRICATION

BACKGROUND OF THE INVENTION

1. Field of the Invention

The present invention relates to a scroll compressor. More specifically, the present invention relates to a scroll compressor having enhanced lubrication by the employment of one or both of a vent arrangement and oil retention features that facilitate oil delivery at compressor start-up and during compressor operation.

2. Description of the Background Art

Scroll compressors typically comprise two basic scroll members each with scroll wraps that interleave to create a series of compression chambers therebetween. Relative movement between the scroll members cyclically recreates such compression chambers at the outer periphery of the scroll members where suction gas enters thereinto. Those chambers close and decrease in volume as the relative orbital motion of the scroll members continues compressing gas therein. Upon reaching the center of the scroll members, the compressed gas is discharged for use.

Lubricant is typically supplied to various scroll compressor components, including an anti-rotation mechanism, bearings and other compressor parts. Such lubricant is typically conveyed from a sump in the lower portion of the compressor through the compressor's drive shaft which drives at least one of the scroll members. Rotation of the drive shaft, which often includes an inclined oil gallery and/or an oil pump, causes lubricant to be drawn from the sump and delivered to the top of the drive shaft and thereafter to locations where lubricant is needed.

In scroll compressors having vertical drive shafts, much of the oil which moves upward through the oil gallery in the drive shaft exits the shaft through a discharge opening at the upper end of the shaft. That opening is typically located below a central region of the end plate of one of the scroll members.

The central region of a scroll member is typically hot due to the compression of gas that occurs at that location. In scroll compressors used in refrigeration systems, the oil conveyed upward through the drive shaft can contain entrained liquid refrigerant or refrigerant in the gaseous form. If in the liquid form, refrigerant conveyed upward through the drive shaft may vaporize in the vicinity of the lubricant opening above the drive shaft due to the heat in that location. Such vaporization or the conveyance of refrigerant gas into this area through the oil gallery can displace oil in a location where it is needed and/or otherwise adversely affect compressor lubrication. For instance, the existence of too much vaporized refrigerant in this area can create a backpressure which operates against and reduces the flow of oil attempting to move upward through the drive shaft.

In attempts to address these problems and/or other concerns, some compressors include a vent or vent-like system. Representative examples of such compressors and/or systems are disclosed in U.S. Pat. Nos. 4,792,296; 4,875,840; 4,877,381; 4,997,349; 5,176,506; 5,533,875; 5,885,066 and 6,102,160. A common drawback of these systems is that the limited radial length of the various vent lines associated with such systems fail to take full advantage of centrifugal force that might otherwise be available to assist in lubricant flow.

Another problem related to the lubricant needs of scroll compressors at compressor start-up relates to the amount of time it may take for oil to make its way to various compressor systems that require lubrication. If the amount of time it takes for such lubricant to reach such surfaces is too great, relatively dry bearing surfaces may be damaged before they become properly lubricated. To address this problem, some compressors have a stand pipe or reservoir installed near the upper end of the shaft. The reservoir can hold a small charge of oil that is stored adjacent and can be delivered to bearing surfaces at compressor start-up. Examples of such compressors and arrangements are found in U.S. Pat. Nos. 4,403,927; 4,575,320; 4,666,381 and 6,012,911. Although such systems may be effective, they can require additional parts or offer additional complexity that may increase a compressor's reliability and/or increase its cost.

SUMMARY OF THE INVENTION

It is an object of the present invention to enhance the delivery of oil to various locations requiring lubrication in a scroll compressor.

It is a further object of the present invention to provide a system which facilitates the separation and removal of gas from lubricant as such lubricant is moved from the compressor sump to surfaces requiring lubrication.

A further object of the present invention is to provide immediate oil delivery to selected surfaces in a scroll compressor upon compressor start-up.

One or more of the above listed objects of the present invention are provided by a scroll compressor the drive shaft of which includes an inclined lubricant gallery through which lubricant is delivered from the compressor sump. The shaft includes a vent arrangement the location and orientation of which is such that refrigerant traveling upward through the drive shaft with the compressor lubricant, which is in gaseous form or which comes to be in gaseous form in its travel, is capable of quickly being removed from critical locations in the lubricant flow path. The outlet of the vent arrangement is located beyond the nominal outside diameter of the drive shaft and takes advantage of the increased centrifugal force such location provides for. Further, oil retention locations are provided such that when the compressor shuts down, oil is retained in such locations. Those locations are adjacent surfaces that require lubrication such that when the compressor next starts up, retained oil is immediately flung onto such surfaces. As a result, an initial lubricant charge is provided to such locations prior to the arrival of a continuous lubricant stream which travels upward through the drive shaft to such locations from the compressor's oil sump subsequent to compressor start-up.

DRAWING FIGURES

FIG. 1 is a schematic illustration of an air conditioning system including the compressor of the present invention.

FIG. 4 is an enlarged view of the upper portion of the compressor drive shaft in the position illustrated in FIG. 3.

DETAILED DESCRIPTION OF THE PREFERRED EMBODIMENT

Figure 2:
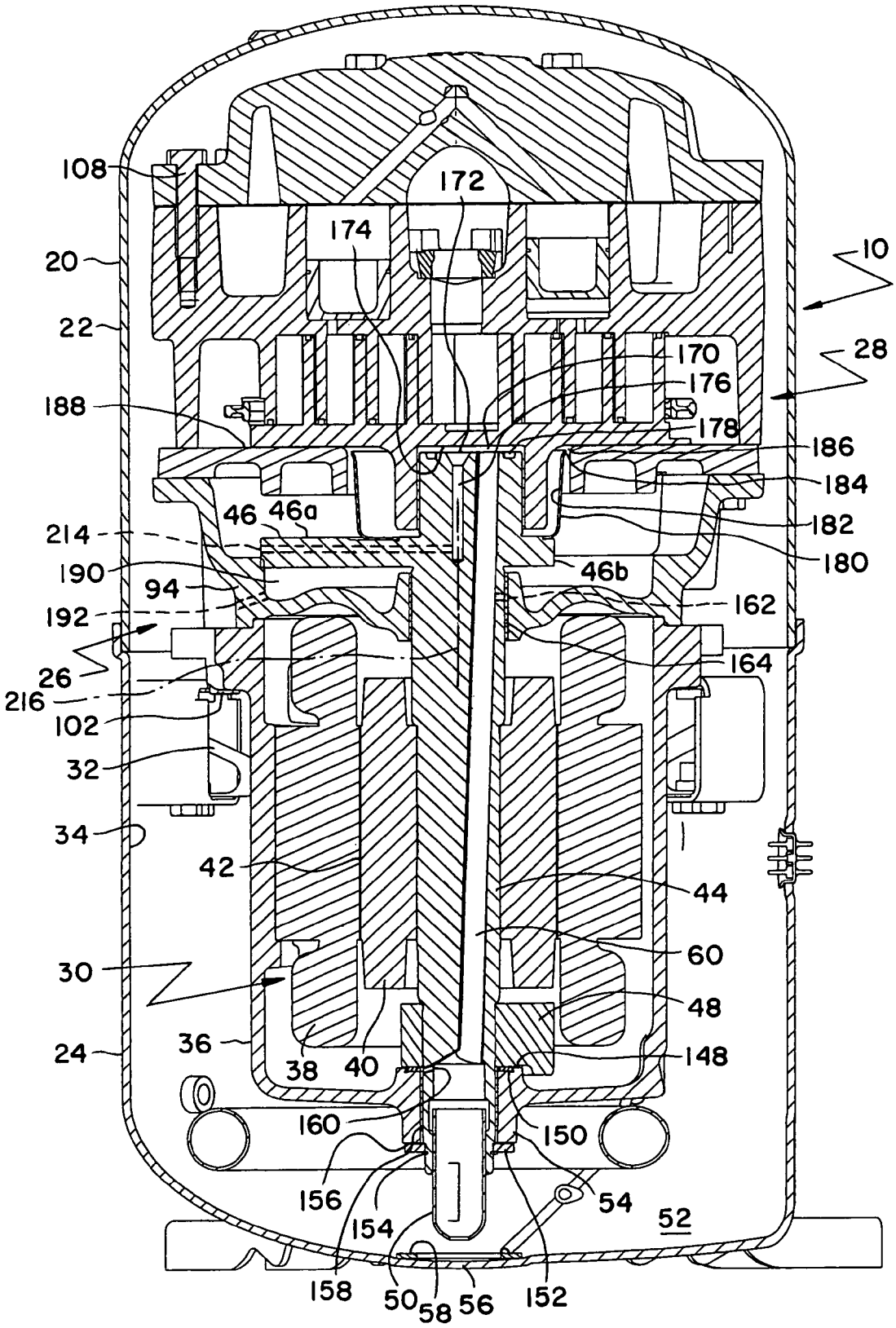
FIG. 2 is a cross-sectional view of the compressor of FIG. 1 with the compressor drive shaft illustrated in a rotational position to best illustrate the oil gallery therethrough and upper counterweight thereof.

Referring initially to FIGS. 1 and 2, scroll compressor 10 of the present invention is, in its preferred embodiment, designed for use in a refrigeration system 12 the primary components of which are compressor 10, condenser 14, expansion device 16 and evaporator 18. Although illustrated as a cooling only system, refrigeration system 12 may be a cooling only system or a heat pump system, the fundamental operation of both of which are well known. As is also well known, such systems can be employed to cool or heat liquid or air. When used to cool a liquid, system 12 is typically referred to as a liquid chiller. When used to cool and/or heat air, system 12 would typically be referred to as an air conditioner or heat pump.

Irrespective of its specific nature, system 12 will employ a refrigerant, such as, for example, one of the refrigerants commonly referred to as R-134a, R407C, R410A or R-22. In operation, the refrigerant in system 12 is drawn from evaporator 18 by compressor 10 as a relatively low pressure gas. Compressor 10 compresses such refrigerant and discharges it to condenser 14 as a higher pressure, higher temperature gas. The refrigerant then flows through condenser 14 in a heat exchange relationship with a relatively cooler medium, most typically water or air, which absorbs heat from the refrigerant gas and removes it from the system. As a result of giving up heat in the condenser, the refrigerant gas condenses to liquid form. The cooled and condensed refrigerant then flows from condenser 14 to and through expansion device 16.

In passing through expansion device 16, the pressure of the condensed refrigerant is reduced, a portion of it flashes to gas and the refrigerant is still further cooled. The now relatively cooler two-phase refrigerant flows into evaporator 18 where it is brought into heat exchange contact with a relatively warmer medium in the form, most typically, of a liquid, such as water, or air. That medium will be carrying heat from the heat load which it is the purpose of refrigeration system 12 to cool. As a result of the heat exchange that occurs in the evaporator, the liquid portion of the refrigerant mixture that enters evaporator 18 vaporizes. The now-heated gaseous refrigerant is returned to compressor 10 while the medium that is cooled in the process is returned to the location of the heat load to provide further cooling thereof.

Referring primarily now to FIG. 2, scroll compressor 10 includes a shell 20 having an upper shell portion 22 and lower shell portion 24. In the preferred embodiment, the lower end of upper shell 22 is sealingly nested in the expanded upper end of lower shell 24. Housed within shell 20 is motor-compressor unit 26 which includes a compressor portion 28 which is drivingly connected to a motor portion 30. Motor-compressor 26 is mounted within shell 20 on a plurality of resilient isolators 32 which, in the preferred embodiment, are mounted between inner wall 34 of shell 20 and motor can 36 in which motor 30 is housed. Motor 30 includes a stator 38 and a rotor 40 between which a gap 42 exists. Stator 38 is fixedly mounted to motor can 36 while rotor 40 is fixedly mounted to drive shaft 44 for rotation therewith.

Drive shaft 44 has, in the preferred embodiment, a counterweight 46 at its upper end, which may or may not be integral with drive shaft 44, and a counterweight 48 at its lower end. Attached to and depending from the lower end of drive shaft 44 is a lubricant pump 50 which extends into oil sump 52 located in the bottom of shell 20. Drive shaft 44 is supported at its lower end in a bearing housing 54 which is, in the preferred embodiment, integrally defined in the lower end of motor can 36.

Lower portion 24 of shell 20 may include a depression 56 in which a magnet 58 is disposed. Magnet 58 is not retained in depression 56 other than by the magnetic attraction of magnet 58 to shell 56. The purpose of magnet 58 is to attract and retain any metallic debris that makes its way into sump 52 so as to prevent such debris from being drawn into oil gallery 60 of drive shaft 44 by the operation of oil pump 50.

Figure 3:
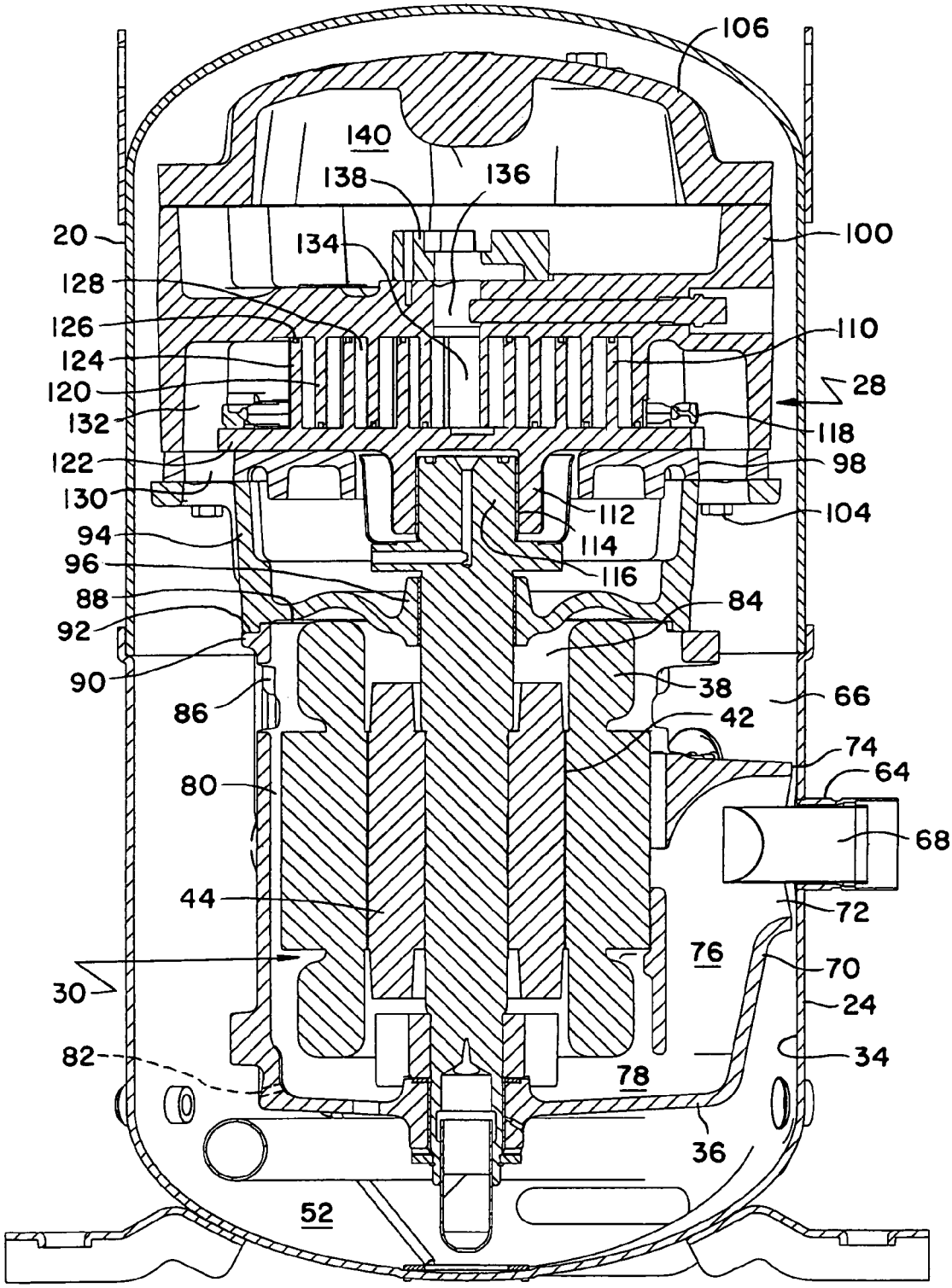
FIG. 3 is a cross-sectional view of the compressor of FIG. 1 taken approximately 45° from the cross-section of FIG. 2 with the compressor drive shaft positioned to best illustrate the preferred vent arrangement of the present invention.

Referring additionally now to FIG. 3, refrigerant gas enters shell 20 of compressor 10 through suction fitting 64 which, in the preferred embodiment, opens into the interior 66 of shell 20 through lower shell 24. A suction screen 68 is disposed such that the refrigerant gas entering shell 20 through suction fitting 64 flows therethrough. The purpose of suction screen 68 is to catch and retain debris that would otherwise flow into the interior 66 of shell 20 in the suction gas stream.

Motor can 36 includes a flared portion 70 which defines an aperture 72 that is aligned with and surrounds suction fitting 64. The distal edge 74 of flared portion 70 is spaced apart from the inner wall 34 of lower shell 24. As a result, the majority of the suction gas entering shell 20 flows directly into the interior of motor can 36 through passage 76 which is defined by flared portion 70 of the motor can. A portion of the suction gas that enters shell 20 does, however, flow directly into the interior 66 of shell 20 through the space between distal edge 74 of flared portion 70 of motor can 36 and the inner wall 34 of shell 20.

As will be appreciated, both the interior 66 of shell 20 and the interior of motor can 36 contain suction gas and will be at suction pressure. Suction gas that flows into the interior of motor can 36 flows through passage 76 into a lower space 78 which is defined at the bottom of motor can 36 around the lower end of stator 38. From space 78, suction gas is drawn upward within the motor can through rotor-stator gap 42 and/or through passages 80 that are defined between motor can 36 and stator 38. A passage 82 is at the bottom of motor can 36 allows for the drainage of any oil that might make its way into the interior of motor can 36, entrained in suction gas, back to sump 52.

The purpose of directing suction gas through motor can 36, space 78, passages 80 and rotor-stator gap 42 is to provide cooling to motor 30. Such gas eventually makes its way to space 84 which surrounds the upper end of stator 38 then flows out of motor can 36 through apertures 86. Such gas, together with the suction gas that enters interior 66 of shell 20 but does not flow through the motor can, is drawn upward within shell 20 to and into compressor 28 by the operation thereof.

The upper open end 88 of motor can 36 includes support structure 90 about its external periphery. Support structure 90 attaches to isolators 32 and includes, in the preferred embodiment, an upper surface 92. Upper bearing frame 94 is supported exterior of motor can 36 on surface 92 and defines an integral upper bearing housing 96 in which drive shaft 44 is rotatably supported at its upper end.

Disposed on and supported by frame 94 is thrust plate 98. Disposed on and supported by thrust plate 98 is fixed scroll member 100. Frame 94, thrust plate 98 and fixed scroll member 100 are fixedly attached to each other such as by bolts 102 while frame 94 and, therefore, both thrust plate 98 and fixed scroll member 100, are fixed to motor can 36 by bolts 104. A discharge cap 106 is supported by fixed scroll 100 and is attached thereto by bolts 108.

Disposed between thrust plate 98 and fixed scroll 100 is orbiting scroll member 110. Orbiting scroll member 110 includes a depending boss 112 in which a bearing 114 is disposed and in which eccentric drive pin 116 of drive shaft 44 is received. The centerline of drive pin 116 is offset from the centerline of drive shaft 44. An anti-rotation device 118, commonly referred to as an Oldham coupling, maintains the orientation of orbiting scroll 110 with respect to fixed scroll 100. As is well known in the art, when drive shaft 44 is caused to rotate by the operation of motor 30, orbiting scroll 110 is driven through drive pin 116 so as to orbit fixed scroll 100.

Projecting from fixed scroll 100 is an involute wrap 120 and projecting from the end plate 122 of orbiting scroll 110 is an involute wrap 124. The wraps of the fixed and orbiting scrolls are interleaved and their tips extend into near contact with the base plate of the opposing scroll member. In the preferred embodiment, a so-called tip seal 126 is disposed in the distal end of each of wraps 120 and 124. Such tip seals follow the involute curve of the wraps and are disposed in an accommodating channel defined in the wrap tips. In the preferred embodiment, such tip seals are biased within the passage in which they reside such that they are urged into contact with the opposing scroll member and form a seal therewith.

Defined by and between the involute wraps of the scroll members are compression chambers 128. As orbiting scroll member 110 orbits with respect to fixed scroll member 100, suction gas is drawn into the chambers 128 from the interior 66 of shell 20. More specifically, suction gas is drawn through apertures 130 defined through frame 94 and thrust plate 98 into space 132 located at the external periphery of the interleaved wraps of the scroll members. As orbiting scroll member 110 orbits with respect to fixed scroll 100, its motion causes initially open compression chambers 128 to be formed on opposite peripheral sides of the interleaved scroll wraps as is well known in the art. The continued orbital motion of the orbiting scroll member causes such chambers close, trapping suction gas therein. Those chambers decrease in volume and ultimately merge into a discharge chamber 134 at the center of the interleaved scroll wraps. The now relatively hot and compressed refrigerant gas is discharged from chamber 134 through discharge port 136 defined by the fixed scroll member.

The discharge gas next flows past discharge check valve apparatus 138 and into discharge volume 140 which is cooperatively defined by fixed scroll member 100 and discharge cap 106. The gas then flows into a discharge line, not shown, which depends downwardly through fixed scroll 100, thrust plate 98 and frame 94 into interior 66 of shell 20. The discharge gas flows through the discharge line which connects to a discharge fitting, not shown, which penetrates lower shell 24 and through which discharge gas flows out of shell 20.

Lubrication

Referring now primarily to FIGS. 2 and 4, drive shaft 44, upper counterweight 46 and lower counterweight 48 are rotatably supported on the upper face 148 of lower bearing housing 54. In the preferred embodiment, a thrust washer 150 is disposed on upper face 148 of lower bearing housing 54 and a shaft movement limiting washer 152 is retained in place on the lower end of drive shaft 44 such as by a snap ring 154 or by press fit. During normal compressor operation, washer 152 will not contact or may be in sporadic light contact with lower face 156 of lower bearing housing 54. If, however, forces develop within compressor 10 such that drive shaft 44 is urged to move upward with sufficient force, washer 152 comes into contact with lower surface 156 of lower bearing housing 54 and limits any such movement so as to reduce noise and prevent damage to the compressor as a result of drive shaft vertical movement.

As drive shaft 44 rotates, oil pump 50 rotates with it within oil sump 52. The rotation of pump 50 together with the angling of oil gallery 60 upward and away from the centerline of drive shaft 44 creates a centrifugal force which causes oil to be drawn out of sump 52 and to flow upward through pump 50 and gallery 60. Lubricant making its way upward through oil pump 50 and crankshaft gallery 60 is fed to and lubricates lower bearing 158, disposed in lower bearing housing 54 in motor can 36, and the interface between thrust washer 150 and lower counterweight 48 at the lower end of drive shaft 44 after having passed out of passage 60 through feed passage 160. Oil making its way further upward within passage 60 is fed through passage 162 to upper crankshaft bearing 164 disposed in frame 94.

Oil traveling still further upward within the drive shaft oil gallery is communicated into the space 170 which is defined between upper face 172 of crankpin 116 and the lower face 174 of orbiting scroll end plate 122. Space 170 is vented through a vent passage 176 so as to promote and assist in the flow of oil through the drive shaft to compressor surfaces that require lubrication. An oil retention groove 178 is found in upper surface 174 of drive pin 116.

The oil that flows into space 170 lubricates crankpin bearing 114 and then make its way into oil cup 180 from where it is urged by the rotation of drive shaft 44 and the centrifugal force that results therefrom, upward along the inner face 182 of the oil cup. Such oil is then directed by flared edge portion 184 of the oil cup to the interface 186 between the lower face 174 of orbiting scroll end plate 122 and thrust surface 188 of thrust plate 98 where it provides lubrication to those surfaces.

When compressor 10 shuts down, some oil is retained in both oil cup 180 and groove 178. Such retained oil is flung out of cup 180 and groove 178 when the compressor next starts up and the drive shaft begins to rotate and is therefore immediately available for lubrication purposes at those respective locations, even before oil begins to flow upward through oil gallery 60 in drive shaft 44 as a result of the pumping action of pump 50. A portion of the oil which exits oil cup 180 will drain or fall downward into volume 190 which is defined within frame 94. Such oil drains thereoutof through a passage 192 and then flows, by force of gravity, downward through interior 66 of shell 20 into oil sump 52.

Referring primarily to FIG. 4 and as noted above, oil drawn upward through oil gallery 60 in drive shaft 44 is delivered out of the end of gallery 60 which opens into upper surface 172 of crank pin 116 of drive shaft 44. Such oil may have liquid refrigerant entrained in it or carry gaseous refrigerant with it. Liquid refrigerant may, by exposure to heat in space 170, vaporize. In order to prevent vaporized refrigerant from creating a back pressure in space 170 which can operate against the upward flow of lubricant through oil gallery 60, vent 176 is defined in shaft 44 for the purpose of removing such gas from space 170 and assisting in the flow of lubricant upward from the compressor sump through oil gallery 60.

Vent 176 has an opening 200 which opens into a generally vertical passage portion 202. Passage portion 202 intersects a generally horizontal passage portion 204 which, in the preferred embodiment, passes through drive shaft 44 as well as counterweight 46. By use of counterweight 46 and its radially extended length outside of the nominal circumferential diameter C of drive shaft 44, the length of passage 204 is increased. As a result, outlet 206 of passage portion 204 is located radially outward of the external surface and nominal diameter of crankshaft 44 and increased centrifugal force is brought to bear in the context of both venting space 170 and assisting in the lift of oil out of the compressor sump.

It is to be noted that the outlet 206 of passage portion 204 is capable of being extended to a radially still further outward location by the use of an extension 208, shown in phantom in FIG. 4. In an alternate arrangement, vertical passage portion 202 is extended further downward within shaft 44 such that the horizontal passage portion of vent 176 extends outward only to the surface of drive shaft 44, as illustrated in phantom as passage 210 in FIG. 4. In such an arrangement, an extension 212, likewise shown in phantom in FIG. 4, is employed to extend the outlet of passage 210 radially outward beyond the surface and diameter C of the drive shaft.

Also to be noted is that horizontal passage portion 204 of vent 176 is capable of being extended significantly further radially outward without the use of an extension if drilled through the extended portion 46*a* of counterweight 46, as is illustrated at 214 in FIG. 2, rather than through the shorter portion 46*b* thereof as in the preferred embodiment. Use of the counterweight to extend the length of passage portion 204 is, in either case, taken advantage of to increase centrifugal force and to enhance bearing lubrication without the use of or need for additional compressor parts.

It is further to be noted that as a result of centrifugal force created by rotation of the drive shaft and the inclination of oil gallery 60, oil delivered from gallery 60 into space 170 is at a location which is offset from the axis of crank pin 116 as is best illustrated in FIG. 2. As a result, lubricant exiting gallery 60 is flung radially outward within space 170 and any lighter refrigerant gas in space 170 will generally tend to gather and be confined to the center of that space in the proximity of the center of upper surface 172 of drive pin 116. The inlet 200 to passage 176 is therefore preferably located in the central region of upper surface 172 of crank pin 116, radially inward from the location at which oil is delivered out of gallery 60 into space 170. This location of inlet 200 facilitates both the removal of gas from space 170 and the drilling of vertical passage portion 202 of vent 176.

It is also to be noted that in the preferred embodiment the axis of vertical passage portion 202 of vent 176 coincides with the axis 216 of drive shaft 44. In such instance and as best illustrated in FIG. 2, the axis of vertical passage portion 202, while coincident with the axis of drive shaft 44, is not coincident with the centerline of crank pin 116 which is offset from the centerline 216 of drive shaft 44. While the centerline of vertical passage portion 202 is, in the preferred embodiment, coincident with the centerline 216 of the crankshaft, it need not be.

Figure 5:
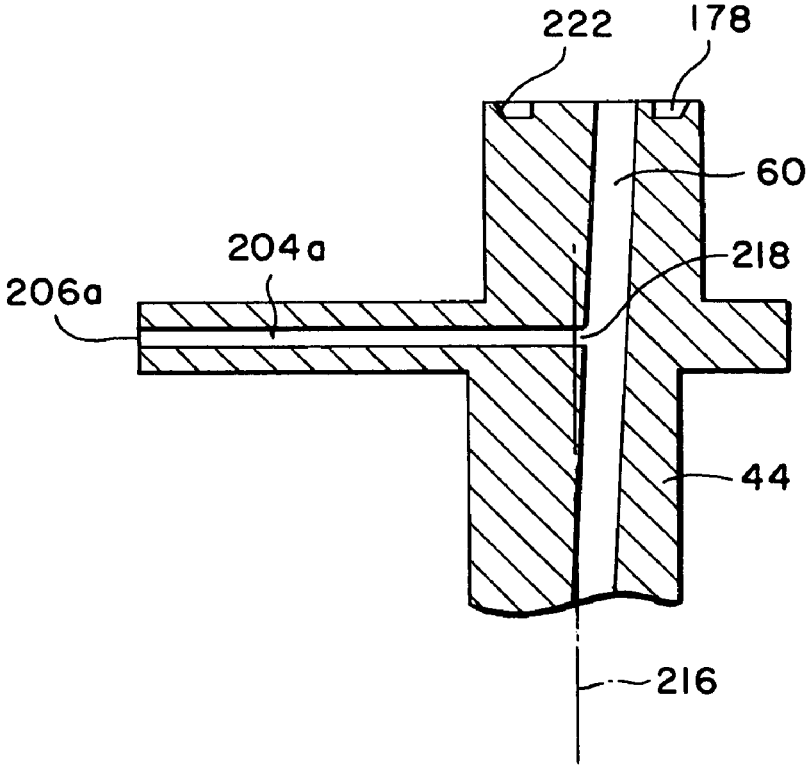
FIG. 5 is an enlarged view of the upper portion of the drive shaft of the compressor of the present invention in the rotational position illustrated in FIG. 2 but with respect to an alternate embodiment of the present invention.

It is still further to be noted, referring additionally now to FIG. 5, that horizontal passage portion 204*a* of the vent arrangement of the present invention could be drilled so as to extend directly into oil gallery 60. In such case, the vertical passage portion of the vent arrangement is eliminated and the inlet 218 to passage portion 204*a* from gallery 60 is on the opposite side of the centerline 216 of drive shaft 44. This ensures that the flow of lubricant into space 170 occurs and is not short circuited through the vent system. It is, however, the FIG. 4 embodiment that is preferred in that it is advantageous to have vent passage 176 in direct flow communication with space 170 rather than with oil gallery 60 to ensure that both oil lift through gallery 60 and the removal of gaseous refrigerant from space 170 is best achieved.

Figure 6:
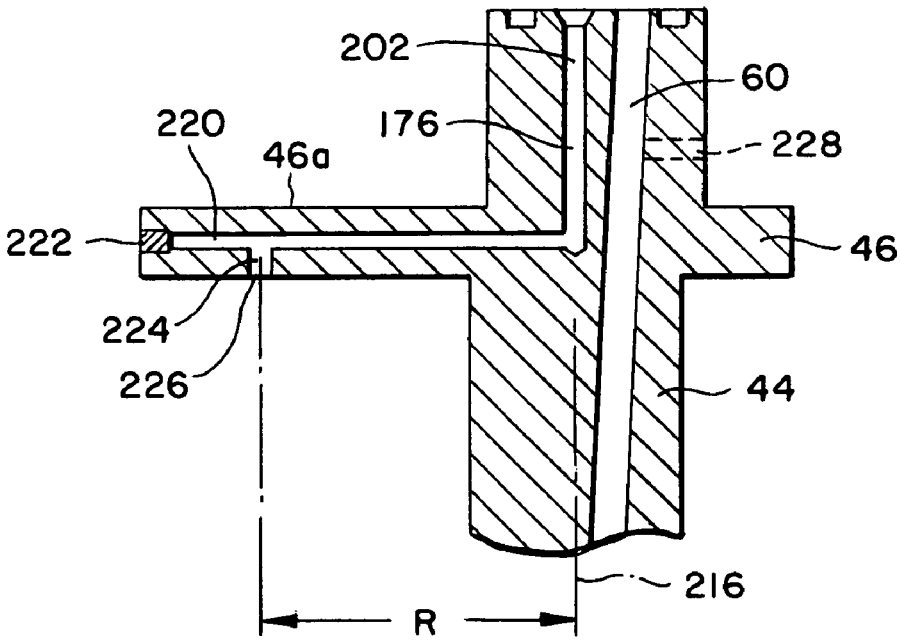
FIG. 6 is the view according to FIG. 5 but illustrating a still further alternate embodiment of the present invention.

Referring now to FIG. 6, in an alternate embodiment of the present invention, vertical passage portion 202 of vent 176 intersects a horizontal passage portion 220 which is drilled through the extended portion 46*a* of counterweight 46. A plug 222 is disposed in the open end of horizontal passage portion 220 and a vertical passage 224 is drilled through counterweight portion 46*a* so as to intersect horizontal passage portion 220. Vertical passage 224 and its outlet 226 are located at a distance R from centerline 216 of drive shaft 44. The distance R from the centerline 216 of drive shaft 44 is a distance which is optimized so as to best control, by the use of centrifugal force, the flow of lubricant through gallery 60 and to the surfaces within compressor 10 which require lubrication.

In essence, the flow of lubricant in compressor 10 is optimized and "tuned" by locating the outlet of vent 176 at a radial distance R from centerline 216 of the crankshaft in accordance with the particular parameters associated with individual compressor designs, including the height/length of the drive shafts and the bearing arrangements of such designs. Generally speaking, the positioning of the outlet from vent 176 at an optimal location is a goal of the preferred and alternate embodiments of the vent arrangements described above though, at this juncture, it is the embodiment of FIGS. 2, 3 and 4 which is preferred.

Finally, it is to be noted that in addition to feeding oil to drive pin bearing 114 from space 170, it may be beneficial to additionally feed oil to that bearing radially, such as through radial feed passage 228 shown in phantom in FIG. 6. The use of such radial feeding of crankpin bearing 114, in addition to delivering oil to bearing 114 from space 170, has the potential to further enhance the cooling and lubrication of that bearing.

Overall, by use of the described venting arrangement and by extending the length of horizontal passage portion 204 and, therefore, the location of the outlet therefrom in the manners described, centrifugal force is made use of to lower the pressure within space 170, which assists in the lifting of oil through oil gallery 60, and the removal of gas from space 170. Such length and outlet location may vary from one compressor design to the next but in each case, the location of the outlet of vent passage 176 will be radially outward of the circumferential surface of the drive shaft so as to provide and develop additional centrifugal force to assist in and enhance the lubricant delivery process.

As previously noted, oil is delivered into space 170 when compressor 10 is in operation. When compressor 10 shuts down, oil in space 170 may drain thereoutof but a portion thereof will be retained in an annular oil retention groove 178. Oil is likewise retained, when the compressor shuts down, at the bottom of oil cup 180. When the compressor next starts up, such retained oil is flung, as a result of the centrifugal force created by the rotation of drive shaft 44, to locations such as thrust plate/scroll member interface 186 and to the location of crank pin bearing 114 where it provides initial lubrication until such time as the flow of oil through gallery 60 provides for the continued lubrication of such surfaces.

Although illustrated as being rectangular in FIGS. 2, 3 and 4, the cross section of groove 178 may be square, "V"-shaped or curvilinear and multiple such grooves, concentric or otherwise may be formed into surface 172 of the crankpin bearing 114. Referring to FIG. 5 for instance, the outer sidewall 222 of groove 178 may be inclined radially outward from bottom to top so as to direct the flow of oil thereoutof in a radially outward direction upon compressor start-up. As will be appreciated, the size, shape and location of groove 178 may vary and rather than a continuous groove or cavity, one or more cavities, perhaps cylindrical and being formed by drilling into surface 172, or another configuration capable of retaining oil at the top of crankpin 116 may be employed and is within the scope of the present invention. It is to be noted that use of a cavity configuration that is continuous around the periphery or circumference of upper surface 172, such as an annular groove, is preferred so that when the compressor starts, retained oil is directed uniformly out of the cavity on all directions so as to best provide lubricant to the entirety of the crankpin bearing. In any case, the oil-retaining cavity, whether it be a groove in the upper surface of the crankpin or another configuration, is preferably machined or formed directly into crankpin 116 so as to be integral therewith and so as not to require that any additional parts be added to the compressor to achieve the oil retention purpose.

While the compressor of the present invention has been described in terms of a preferred embodiment, it will be appreciated that alternatives thereto are readily envisions which will fall within the scope of the present invention and the following claims:

What is claimed is:

1. A scroll compressor comprising:

a shell containing a lubricant;

an orbiting scroll member disposed within the shell;

a fixed scroll member disposed within the shell;

an anti-rotation device, said anti-rotation device being engaged with said fixed scroll member and said orbiting scroll member;

a motor, said motor having a rotor;

a drive shaft;

a bearing encircling said drive shaft; and said drive shaft having an upper surface that defines a lubricant gallery opening, said drive shaft defining a lubricant gallery that conveys the lubricant to the lubricant gallery opening, said drive shaft being engaged with the rotor of said motor such that rotation of said rotor causes rotation of said drive shaft, said drive shaft further being drivingly engaged with said orbiting scroll member via the bearing, and an annular groove that encircles the lubricant gallery opening, has an outer wall that is radially inwardly spaced from the bearing and axially adjacent to the bearing, and retains at least some of the lubricant when said compressor shuts down such that when said compressor next starts up, lubricant retained in said annular groove is flung outward toward said bearing and is made available for immediate use in lubricating said bearing.

2. The scroll compressor according to claim 1 wherein the radially outer wall of said annular groove is angled so as to direct the flow of retained lubricant out of said annular groove when said compressor starts up.

3. The scroll compressor according to claim 1 wherein the annular groove in said upper surface is concentric with said bearing.

4. The scroll compressor according to claim 1 wherein said annular groove has an outer wall that is substantially cylindrical.

5. The scroll compressor according to claim 1 wherein said annular groove is integrally formed within said upper surface.

6. The scroll compressor according to claim 1 wherein said orbiting scroll member has an end plate and houses said bearing, said orbiting scroll end plate and said upper surface of said drive shaft defining a space into which lubricant is delivered through said lubricant gallery opening, said space being in flow communication with said bearing and lubricant delivered to said space flowing to said bearing, said space being generally full of lubricant when said compressor is in operation, lubricant generally draining out of said space when said compressor shuts down other than any lubricant retained in said annular groove.

7. The scroll compressor according to claim 1 wherein the cross section of said annular groove is generally rectangular.

8. The scroll compressor according to claim 1 wherein the cross section of said annular groove is substantially square.

9. The scroll compressor according to claim 1 wherein the cross section of said annular groove is curvilinear.

10. The scroll compressor of claim 1 wherein said annular groove is substantially concentric with said bearing.

* * * * *